US005782668A

United States Patent [19]

Chabert

[11] Patent Number: 5,782,668

[45] Date of Patent: Jul. 21, 1998

[54] ILLUMINATING INFLATABLE BALLOON

[75] Inventor: Pierre Gabriel Chabert, St. Martin d'Heres, France

[73] Assignee: Airstar, Poisat, France

[21] Appl. No.: 727,422

[22] PCT Filed: Apr. 27, 1995

[86] PCT No.: PCT/FR95/00550

§ 371 Date: Oct. 18, 1996

§ 102(e) Date: Oct. 18, 1996

[87] PCT Pub. No.: WO95/29739

PCT Pub. Date: Nov. 9, 1995

[30] Foreign Application Priority Data

Apr. 29, 1994 [FR] France ..... 94 05216

[51] Int. Cl.[6] ..... A63H 37/00

[52] U.S. Cl. ..... 446/220; 446/485; 446/486

[58] Field of Search ..... 446/180, 183, 446/184, 186, 220, 222, 485, 486; 362/806, 809, 394

[56] References Cited

U.S. PATENT DOCUMENTS

| | | | |
|---|---|---|---|
| 3,610,916 | 10/1971 | Meehan . | |
| 4,015,111 | 3/1977 | Spector | 446/220 |
| 4,463,513 | 8/1984 | Wallace | 446/222 |
| 4,464,861 | 8/1984 | Fogarty et al. | 446/485 |
| 4,542,445 | 9/1985 | Marletta | 446/485 |
| 4,704,934 | 11/1987 | Nosrati | 446/220 |
| 4,934,986 | 6/1990 | Wallace | 446/220 |
| 5,102,364 | 4/1992 | Kubiatowicz | 446/220 |
| 5,215,492 | 6/1993 | Kubiatowicz | 446/220 |
| 5,434,761 | 7/1995 | Lesnick et al. | 446/485 |

FOREIGN PATENT DOCUMENTS

| | | | |
|---|---|---|---|
| 717535 | 1/1932 | France . | |
| 3015962 | 11/1981 | Germany . | |
| 2027351 | 2/1980 | United Kingdom | 446/220 |

*Primary Examiner*—Robert A. Hafer
*Assistant Examiner*—Jeffrey D. Carlson
*Attorney, Agent, or Firm*—Oliff & Berridge, PLC

[57] ABSTRACT

An illuminated inflatable balloon, with an envelope inflated with a gas, is connected to the ground by an elongate element. The envelope encloses an electrical bulb connected to an electrical power supply. Spring loaded filar elements are sensitive to the deformation of the envelope, as well as the internal pressure of the gas. The spring loaded filar elements cooperate with a control hairpin for actuating a switch interposed in the connection between the bulb and the electrical supply in order to make and break the connection on either side of a predetermined threshold.

8 Claims, 6 Drawing Sheets

ILLUMINATING INFLATABLE BALLOON

BACKGROUND OF THE INVENTION

1. Field of the Invention

The present invention relates to an improvement to inflatable and possibly illuminating balloons.

2. Description of Related Art

Balloons are known which comprise an envelope that can be inflated with a gas, which are capable of being connected to the ground by an elongate element in such a way that the balloon inflated with a lighter-than-air gas can be kept at a certain height from the ground, and which enclose a means of illumination capable of being connected to an electrical power supply, for example the mains, by means of a conducting wire, in such a way that the balloon and the inscriptions that its envelope may carry can be easily seen, especially at night.

SUMMARY OF THE INVENTION

The improvement according to the invention is such that the balloon comprises actuation means which are sensitive to the deformation of the said envelope and/or to the pressure of the gas in this envelope and are capable of acting on a member for actuating switching means interposed in the connection between the said illumination means and the said electrical power supply in order to make/break this connection on either side of at least one defined threshold.

According to the invention the said actuation means are preferably arranged at least partly inside the said envelope.

According to a preferred embodiment, the said actuation means comprise at least one filar element extending in the said envelope and connecting part of this envelope to the said actuation member, placed at another point on the periphery of this envelope.

In a variant, the said actuation means may comprise at least one spring forming, at least partly, the said filar element and acting before the said switching means are actuated.

In another variant, the said actuation means may comprise at least one spring acting in the direction counter to the tension in the said filar element and acting before the said switching means are actuated.

In another variant, the said actuation means may comprise at least one first spring forming, at least partly, the said filar element and at least one second spring acting in the direction counter to the tension in the said filar element, the first spring having an elongation coefficient greater than that of the second spring.

According to the invention, the said actuation means may advantageously comprise a support-plate fastened to the said envelope and carrying in this envelope a bearing surface, one of the ends of the said spring acting in the direction counter to the tension in the said filar element being placed against this bearing surface, on the side of this support-plate, and the said actuation member comprising a part extending through this spring and having a part on which the other end of this spring bears.

According to the invention, the said actuation member may advantageously comprise a filar element having the shape of a hairpin, the branches of which extend through the said spring and the ends of the branches of which are bent, the said filar element being connected to the loop of this hairpin and the said spring bearing on these bent-over ends.

BRIEF DESCRIPTION OF THE DRAWINGS

The present invention will be better understood by studying a balloon described by way of non-limiting example and depicted in the drawing in which.

DETAILED DESCRIPTION OF PREFERRED EMBODIMENTS

Figure 1:
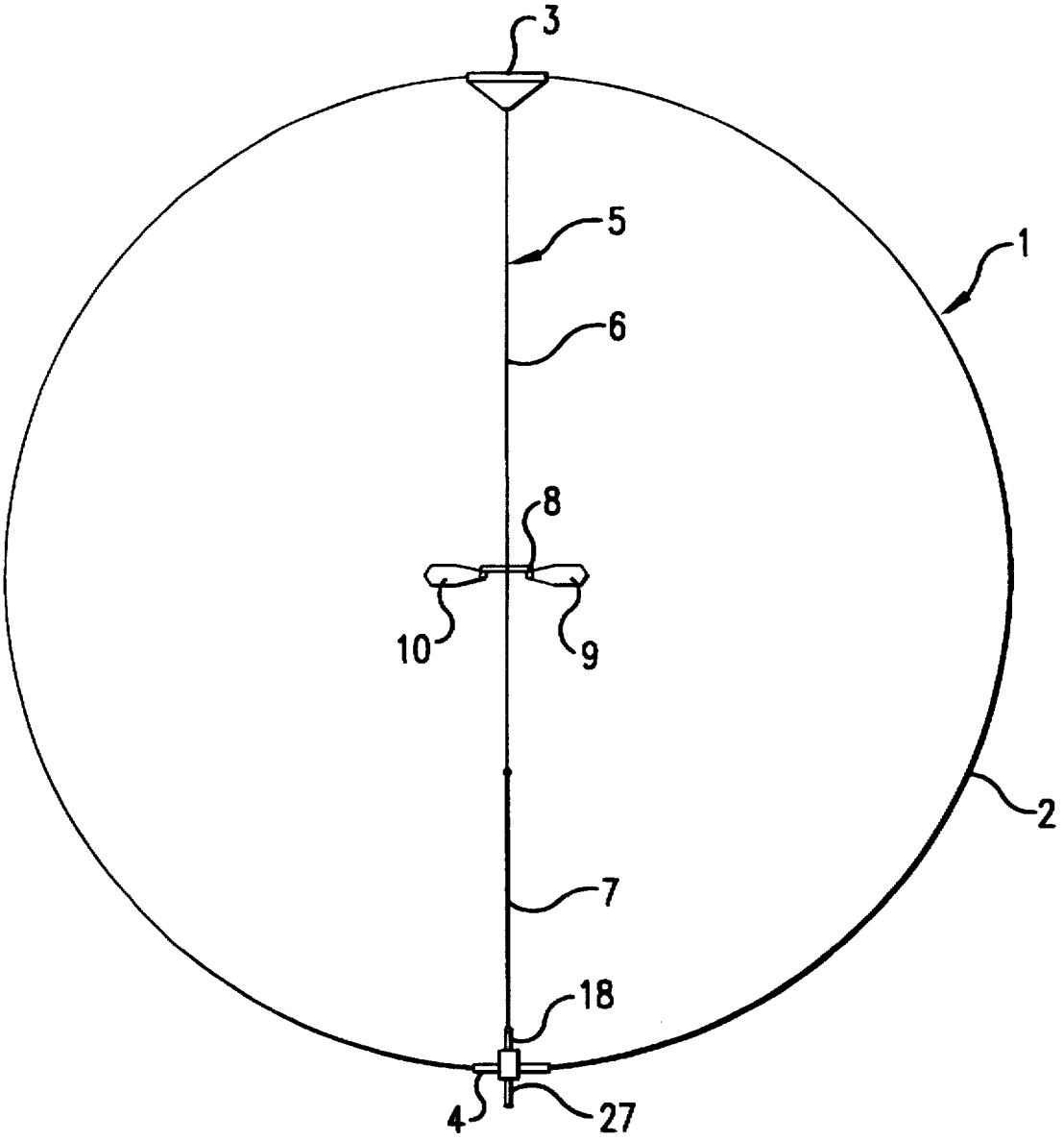
FIG. 1 depicts a balloon in the inflated state.
Figure 2:
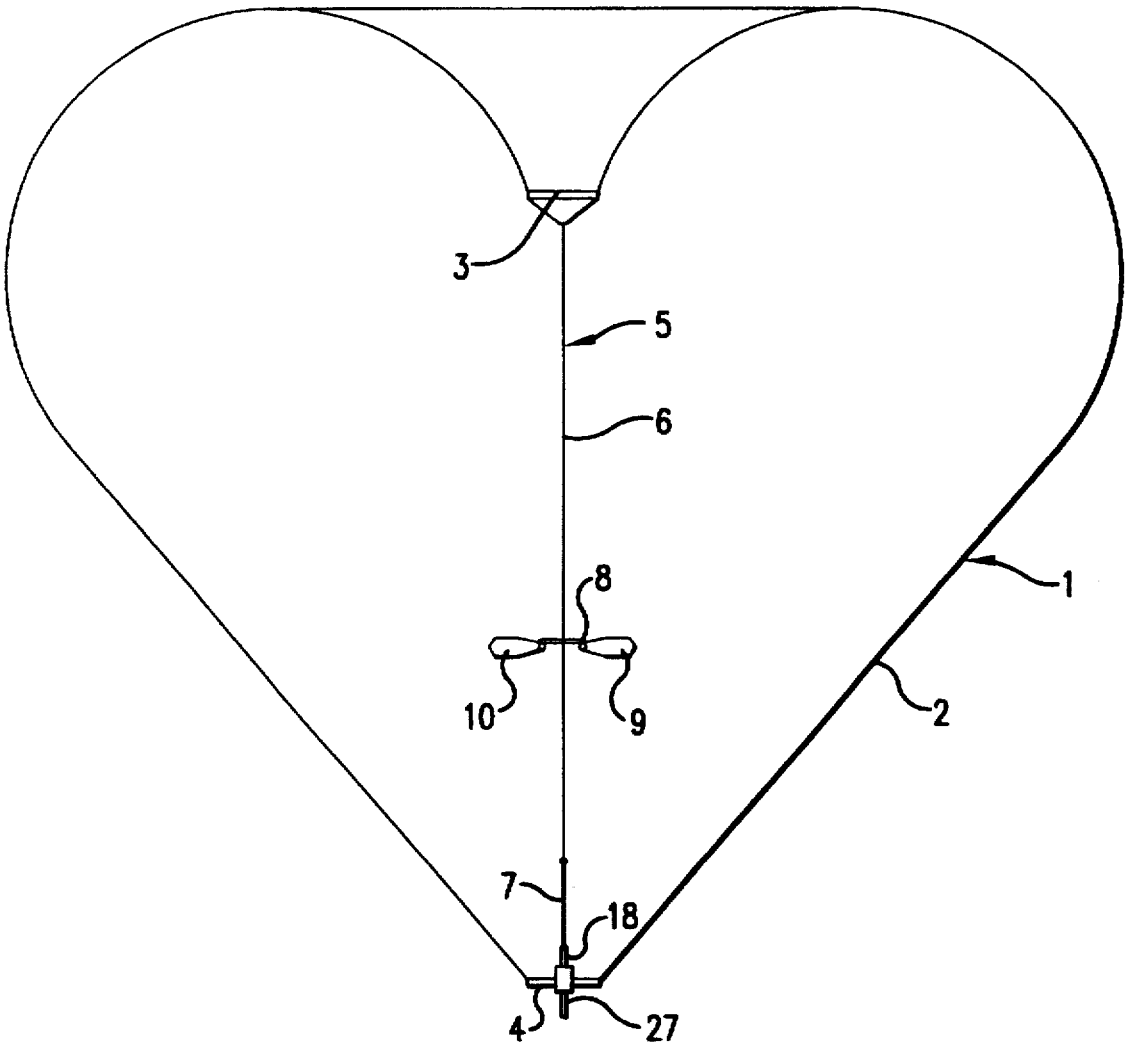
FIG. 2 depicts the balloon according to claim 1 in the slightly deflated state.

The balloon depicted in FIGS. 1 and 2 comprises an envelope 2, made of a transparent or translucent flexible material for example, which, when it is inflated with a lighter-than-air gas for example, has the shape of a sphere.

This envelope has, at its upper part or North Pole, a circular passage in which a support-plate 3 is fixed in a sealed manner and has, at its lower part or South Pole, a circular opening in which a support-plate 4 is fixed in a sealed manner.

Between the support-plate 3 and the support-plate 4, the balloon 1 has a filar element 5 which comprises a flexible wire 6, the upper end of which is fixed in a known manner to the upper support-plate 3, and a spiral spring 7, the upper end of which is fixed to the lower end of the wire 6 and the lower end of which is connected to the support-plate 4, as will be described later.

Fixed to the wire 6 is a bulb support 8 carrying two opposed bulbs 9 and 10.

As may be seen in FIG. 1, when the balloon 1 is in the inflated state, the filar element 5 extends vertically along a diagonal of the envelope 2, the spring 7 being tensioned.

When the balloon is inflated, the support 8 carrying the bulbs 9 and 10 is substantially in the middle of the filar element 5, substantially equidistant from the support-plates 3 and 4.

When the balloon 1 is deflated by intentional or unintentional release of the gas contained in the envelope 2, the length of the filar element 5 decreases, especially due to the effect of the tension caused by the spring 7, the upper part of the envelope 2 comes down and the lower part of the envelope tends to move closer to the vertical axis in such a way that the balloon adopts, in cross-section, substantially the shape of a heart or of a pear.

As may be seen in FIGS. 3 to 6, the support-plate 4 is arranged on the outside of the envelope 2 and its peripheral part is coupled to a ring 11 arranged inside the envelope 2 by means of screws 12 distributed on the periphery, the edge of the aforementioned lower opening in the envelope 2 being held between the peripheral part of the support-plate 4 and this ring 11, a seal 13 being interposed between this edge of the envelope 2 and the support-plate 4. The upper support-plate is fixed in an equivalent manner.

At its central part, the support-plate 4 has a cylindrical projecting part 14 which extends towards the interior of the envelope 2.

Arranged in this projecting part 14 is a spiral spring 15, the upper end of which bears against a circlip 16 fitted in the upper part of this cylindrical part 14.

The lower end of the spring 7 is fixed to the loop 17 of a hairpin 18 which has two branches 19 and 20 that extend downwards through the spring 15 and which has ends 21 and 22 bent radially outwards, substantially parallel to the support-plate 4, the end of the spring 15 bearing on these bent-over parts 21 and 22.

In order to allow the branches 21 and 22 of the hairpin 18 to pass through laterally, the cylindrical projecting part 14 has two diametrically opposed vertical slots 23 and 24 open towards the top. In order to limit the downward travel of the hairpin 18 due to the effect of the extension of the spring 15, these slots 23 and 24 have a defined length so that the bent-over parts 21 and 22 of the hairpin 18 bear against the bottom of them.

On one side, the cylindrical part 14 of the support-plate 4 carries an electrical switch 25, the moving actuation contact 26 of which is located vertically so as to face the end part 21 of the hairpin 18.

The balloon 1 furthermore has a sheathed electrical cable 27, one end of which is fixed to the support-plate 4 in a sealed manner by means of a known nut system 28 and the other end of which is capable of being fixed to the ground so as to be able to keep the balloon in the inflated state at a defined height.

The electrical conductors 29, which are contained in the cable 27 and which emerge inside the cylindrical part 14, pass through a hole 30 made in the wall of this cylindrical part and are electrically connected to the switch 25, the latter being electrically connected to the bulbs 9 and 10 via a conductor of appropriate length.

Figure 3:
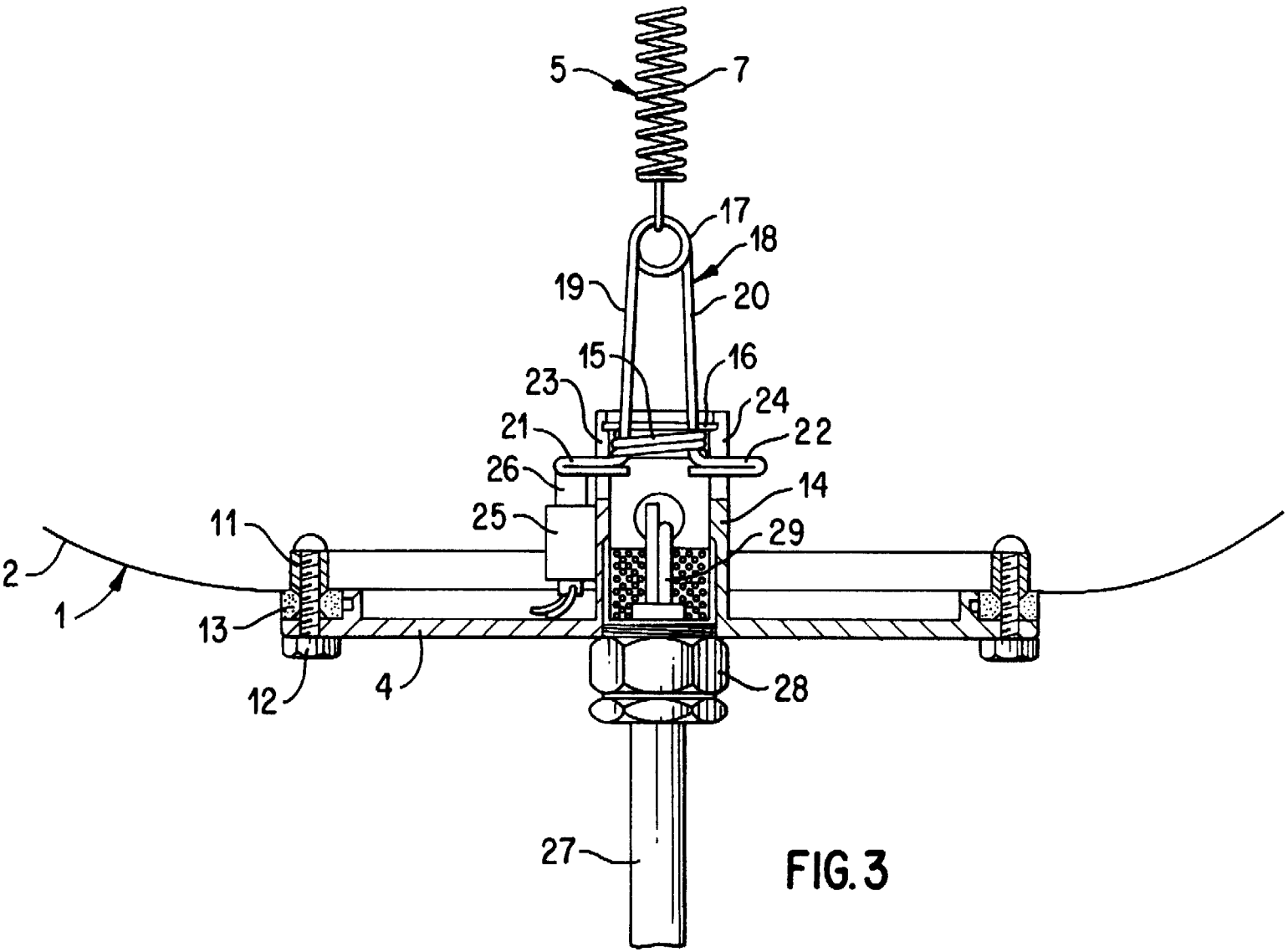
FIG. 3 depicts, in enlarged view and in vertical section, the lower part of the aforementioned balloon, the balloon being inflated.

As may be seen in particular in FIG. 3, when the balloon 1 is in the inflated state the spring 7 is tensioned and the spring 15 is compressed, the hairpin 18 being in a high position in such a way that its end part 21 is in its high position and that the actuation contact 26 of the switch 25 makes the electrical connection between the conductor 29, connected to the ground to an electrical power supply, and the bulbs 9 and 10 which are then lit up.

When the balloon 1 deflates, as was seen above, the distance between the support-plates 3 and 4 decreases, while the filar element 5 remains tensioned due to the effect of the spring 7, the length of which progressively decreases.

Figure 4:
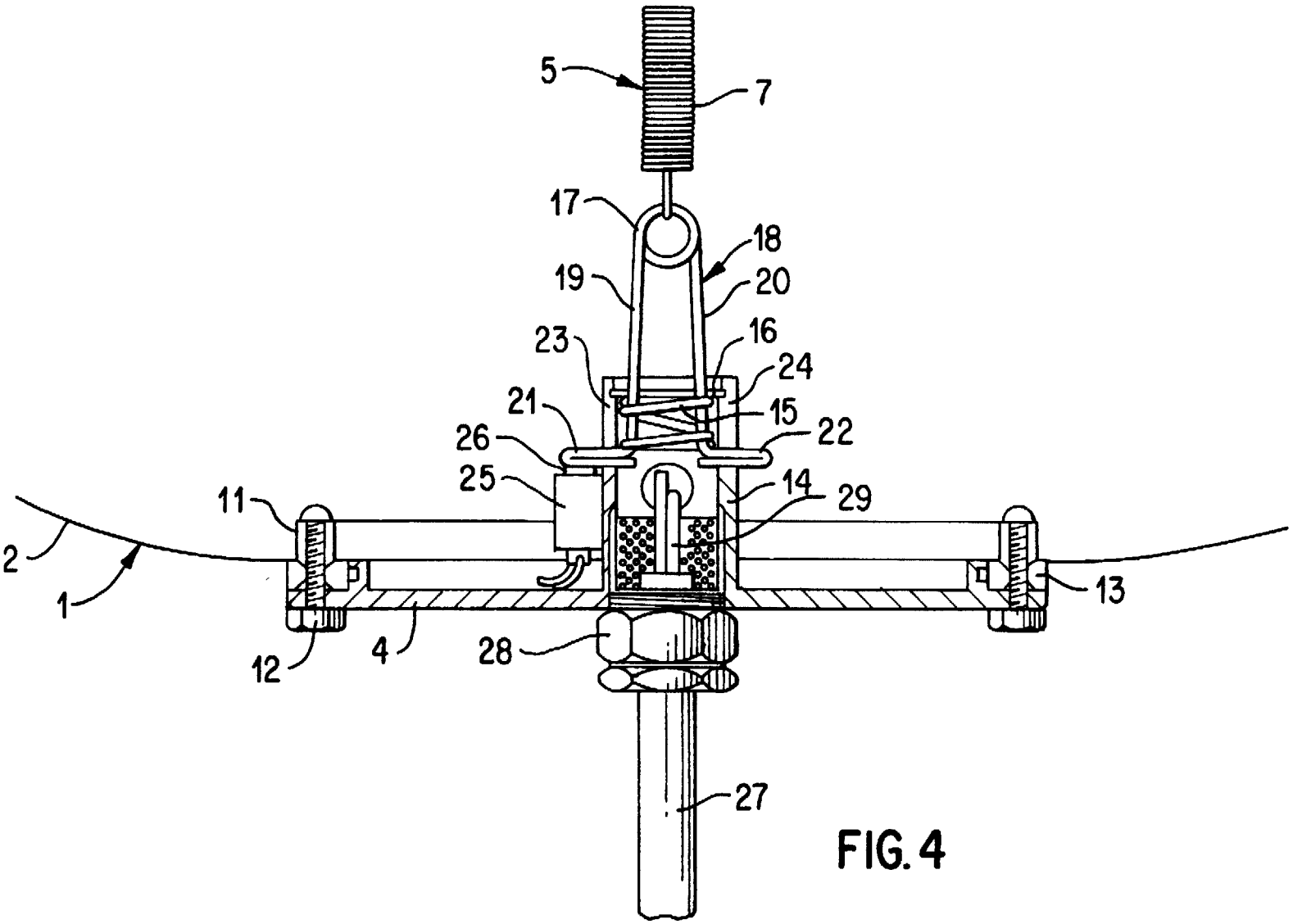
FIG. 4 depicts a view corresponding to FIG. 3, the balloon being at least partially deflated.

Since the elongation coefficient of the spring 7 is chosen so as to be quite appreciably greater than the elongation coefficient of the spring 15 which acts in the direction counter to the tension established in the filar element 5, within a defined length of the filar element 5, the hairpin 18 moves downwards in such a way that its end part 21 bears on the actuation contact 26 of the switch 25 in order to bring it into its retracted position seen in FIG. 4, in which position the circuit supplying the bulbs 9 and 10 is broken.

By means of the combination of the springs 7 and 15 in opposition, the variation in length of the filar element 5, enabling the switch 25 to pass from its on position to its off position, is short. This enables, at least partly the bulbs 9 and 10 to be prevented from flashing.

Thus the aforementioned safety means for switching the bulb-supplying circuit on and off are subjected to the variation in the shape of the envelope 2 which itself depends on the pressure in this envelope.

Figure 5:
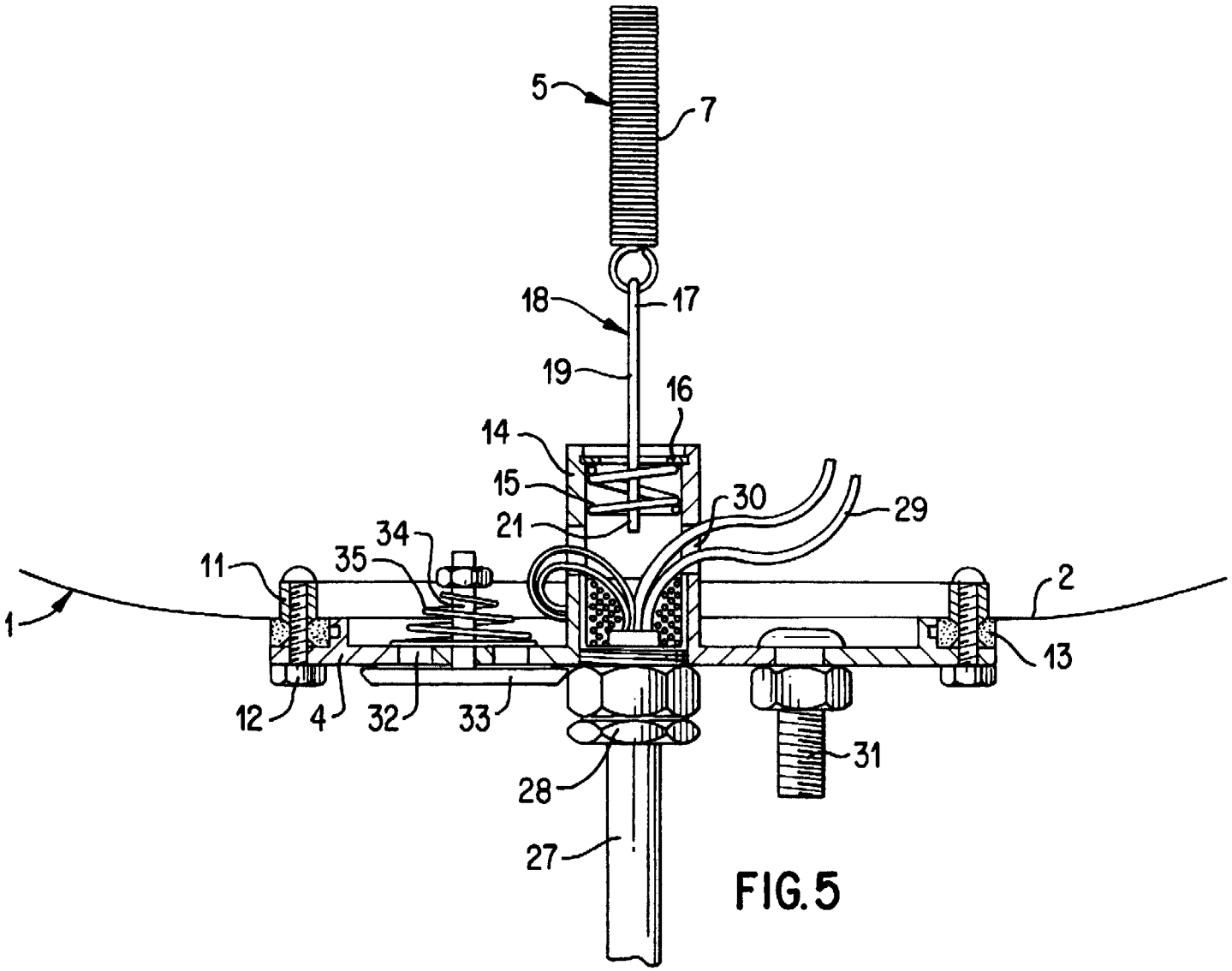
FIG. 5 depicts an enlarged vertical section of the lower part of the aforementioned balloon, perpendicular to FIG. 4.
Figure 6:
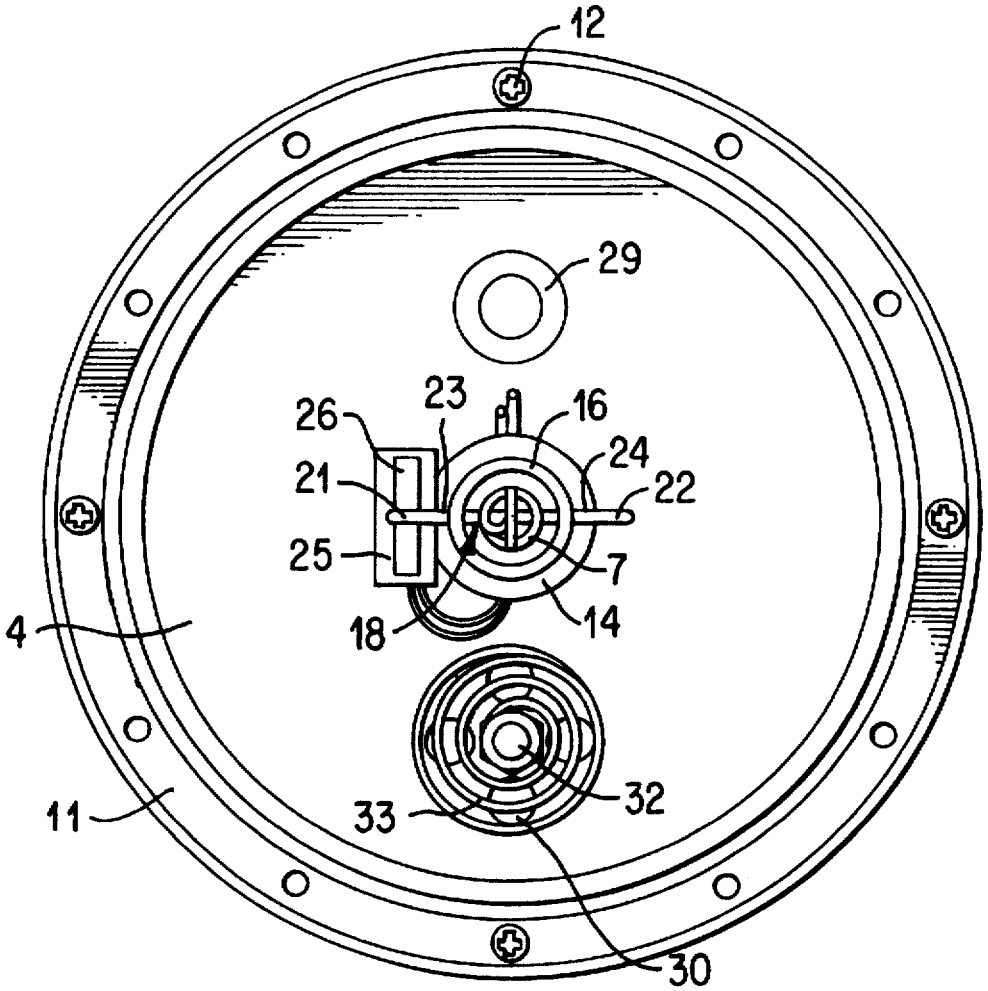
FIG. 6 depicts a view from above of that lower part of the aforementioned balloon depicted in FIGS. 3 to 5.

Additionally, as may be seen in particular in FIG. 5, the support-plate 4 is equipped with a valve 31 enabling the balloon 1 to be inflated. This support-plate furthermore has through-passages 32 covered on the outer side by a plate 33 forming a safety valve, this plate 33 having a pin 34 passing through the support-plate 4, a return spring 35 being interposed between the inner end of the pin 34 and the inner face of the support-plate 4.

The present invention is not limited to the examples described hereinabove. Many alternative embodiments are possible without departing from the scope defined by the appended claims.

I claim:

1. An illuminated inflatable balloon, comprising:

an envelope inflated with a gas, said envelope being connected to the ground by an elongate element;

illumination means enclosed within said envelope and electrically connected to an electrical power supply;

actuation means sensitive to one of a deformation of said envelope and a variation in an internal pressure of the gas in said envelope, said actuation means cooperating with a control member; and switching means interposed in the electrical connection between said illumination means and said electrical power supply, said electrical switching means being actuated by said control member in order to manipulate the electrical connection between an open position when said internal pressure within said envelope is on a first side of a predetermined threshold and a closed position when said internal pressure within said envelope is on a second side of said predetermined threshold.

2. The illuminated inflatable balloon according to claim 1, wherein said actuation means is arranged at least partly inside said envelope.

3. The illuminated inflatable balloon according to claim 1, wherein said actuation means comprise at least one filar element extending in said envelope, and connecting part of said envelope to said control member, placed at another point on the periphery of said envelope.

4. The illuminated inflatable balloon according to claim 3, wherein said actuation means comprise a first spring forming said filar element and being active before tripping of said switching means to an OFF position.

5. The illuminated inflatable balloon according to claim 4, wherein said actuation means comprise a second spring acting in the opposite direction of said filar element, before tripping of said switching means to the OFF position.

6. The illuminated inflatable balloon according to claim 5, wherein said first spring has an elongation coefficient greater than that of the second spring.

7. The illuminated inflatable balloon according to claim 5, wherein said actuation means further comprises:

a support-plate fastened to said envelope and carrying a bearing surface in said envelope;

a first end of said second spring being placed against said bearing surface, on the side of said support-plate; and said control member including a first part extending through said second spring, and a second part coming into engagement with a second end of said second spring.

8. The inflatable illuminated balloon according to claim 7, wherein said control member comprises a filar element having a hairpin shape, said filar element being provided with a loop and two branches extending through said second spring and having a pair of bent-over ends, said filar element being connected to said loop so that said second spring bears on said bent-over ends.

* * * * *